United States Patent [19]

McCartney

[11] Patent Number: 4,700,637

[45] Date of Patent: Oct. 20, 1987

[54] VOLUME REDUCTION OF LOW-LEVEL RADIATION WASTE BY INCINERATION

[75] Inventor: Michael S. McCartney, Bloomfield, Conn.

[73] Assignee: Combustion Engineering, Inc., Windsor, Conn.

[21] Appl. No.: 325,414

[22] Filed: Nov. 27, 1981

[51] Int. Cl.[4] ..... F23G 7/00

[52] U.S. Cl. ..... 110/237; 110/190; 110/211; 110/214; 110/238; 110/264

[58] Field of Search ..... 110/186, 190, 235, 237, 110/238, 256, 264, 265, 210–214; 431/174, 175

[56] References Cited

U.S. PATENT DOCUMENTS

| | | | |
|---|---|---|---|
| 3,792,671 | 2/1974 | Woods | 110/190 |
| 4,294,178 | 10/1981 | Borio et al. | 110/265 |
| 4,316,878 | 2/1982 | Akune et al. | 110/238 |
| 4,351,252 | 9/1982 | Shindome et al. | 110/237 |

FOREIGN PATENT DOCUMENTS

| | | | |
|---|---|---|---|
| 0012913 | 2/1981 | Japan | 110/235 |

*Primary Examiner*—Albert J. Makay
*Assistant Examiner*—Steven E. Warner
*Attorney, Agent, or Firm*—Richard H. Berneike

[57] ABSTRACT

An incinerator, or furnace, receives low-level radiation waste from a nuclear installation in varying volumes and calorific values. A supplemental, conventional fuel is concomitantly supplied under the control of the exhaust temperature of the products of combustion. The low-level radiation waste and supplemental fuel are mixed with combustion air in a first stage where combustion is initiated, the products of combustion being flowed downward into a second stage where the combustion is complete prior to exhaust.

2 Claims, 1 Drawing Figure

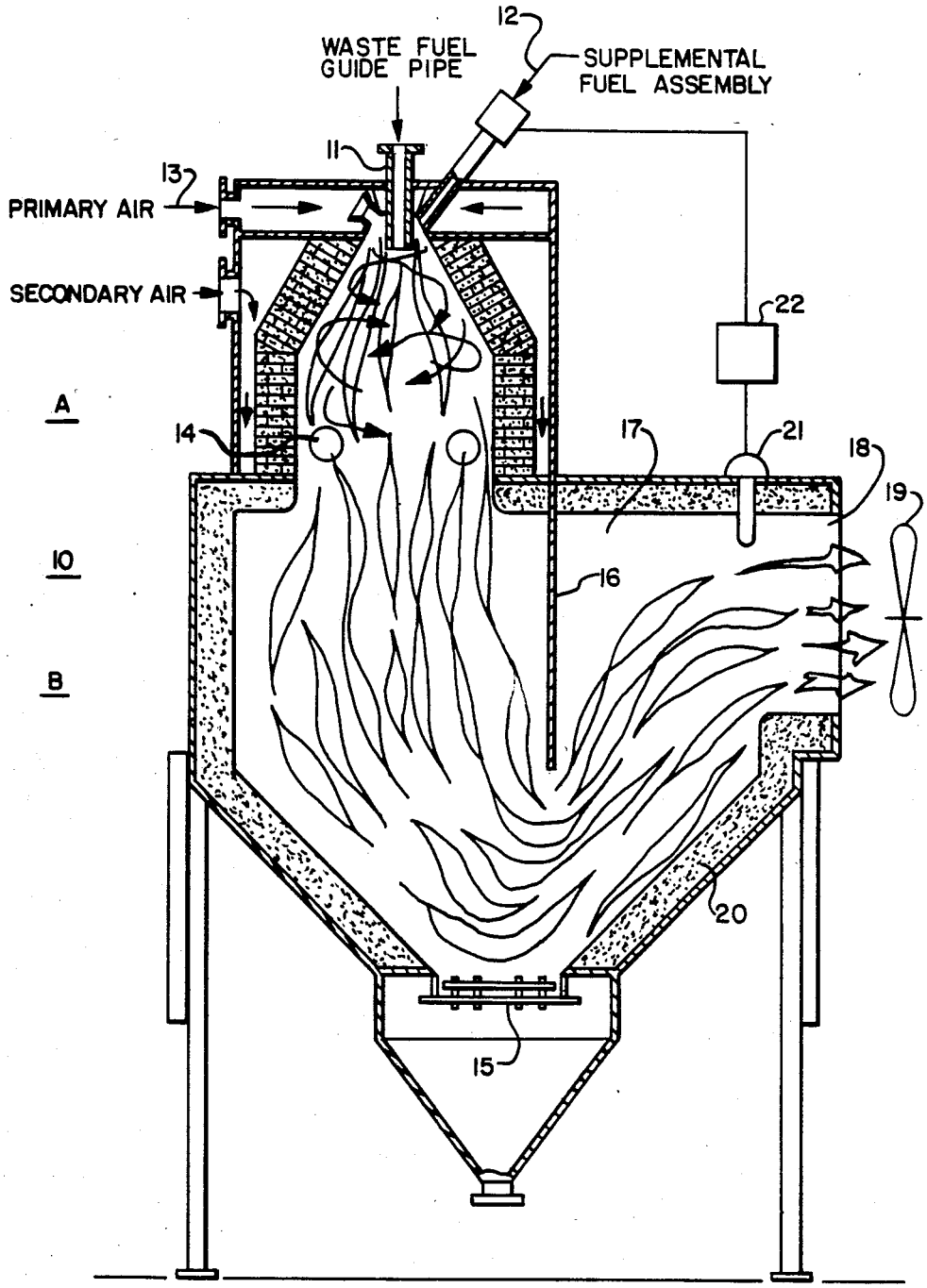
12
WASTE FUEL GUIDE PIPE
SUPPLEMENTAL FUEL ASSEMBLY
11
13
PRIMARY AIR
SECONDARY AIR
22
A
14
17
21
18
19
10
16
B
20
15

VOLUME REDUCTION OF LOW-LEVEL RADIATION WASTE BY INCINERATION

TECHNICAL FIELD

The present invention relates to the combustion of material, having a wide range of calorific value, gathered as low-level radiation waste from a nuclear power installation. More particularly, the invention relates to the volumetric reduction of low-level radiation waste material by incineration.

BACKGROUND ART

Great concern has developed over the reduced capacity of available disposal sites for radiation-contaminated waste from nuclear power plants. The quantity of low-level radiation-contaminated waste has begun to saturate the available capacity of permanent disposal sites. If decent burial is to be made of this material in the future, some means of drastically reducing its volume will be required.

The need for volumetric reduction instinctively stimulates the conscious mind to visualize some form of combustion, or incineration, of this type of waste. Present combustion practices have been examined, including controlled air, multiple-chamber, and fluid bed designs. In each case, the evaluations considered how each design met four fundamental combustion criteria which have been employed to supply utility and industrial boilers and industrial incinerators. Effective, complete, safe combustion requires sufficient residence time, high temperature, turbulence, and excess air. An excess air condition exists any time there is a supply of air available to the combustion process which is oreater than the amount required for 100% stoichiometry. Further, low-level radioactive waste requires special condsiderations because of its wide range in heating value, variable form, and hazardous nature.

Typical low-level radioactive contaminated wastes consist of liquid concentrates, resin slurries and sludges, and dry combustible solids. The heating value of these wastes vary from zero, for the liquid concentrates, to as much as 19,000 Btu/lb. for dry solids. Complete combustion, or evaporation, of the wastes having this calorific range presents a challenge in balancing sufficient combustion air, supplemental fuel, and quantity of waste input at all times.

The varying form of radioactive wastes is also a concern since wide ranges of waste particle size and density must be accommodated. These wastes can range from light dry solids, such as shredded paper and cloth weighing 20 lbs/cu.ft., to heavier and much smaller resin beads weighing 60 lbs/cu.ft. The hazardous nature of the waste dictates that safety in its processing be a paramount design consideration.

After a gathering, or collecting, system has been provided to select the radiation waste from multiple sources of a nuclear installation, a subsystem must be provided to reduce the form of the waste into a satisfactory form of feed for an incinerator. The incinerator must be provided with a parallel supply of conventional fuel to insure the continuous combustion of the radiation waste. The form of incinerator must provide a flow path for the waste and supplemental fuel which will result in maximum volume reduction of the waste. Finally, the supplemental, conventional fuel must be controlled to insure consistent, satisfactory combustion conditions within the incinerator as the calorific value of the wastes fluctuates.

DISCLOSURE OF THE INVENTION

The present invention contemplates a two-stage combustion, or incineration, process within chambers effectively insulated with refractory. The low-level radiation waste is received by the first stage in parallel with a supplemental, conventional fuel. Primary air for combustion is introduced into the first stage and directed to mix with the waste and conventional fuel in a cyclonic pattern as ignition begins. The ignited mixture of waste and conventional fuel and air is directed downwardly from the first stage and supplied with the quantity of secondary air which will insure a total of air in excess of that required for stoiciometric combustion. The combustion from the first stage is directed vertically downward into the second stage chamber which provides the residence time required for substantially complete combustion. Baffling is provided in the second stage to form a flow path for the products of combustion which deviates sharply upward from the bottom of the second stage chamber to cause waste solids to be deposited on a grate beneath the diverted path on which the solids are retained for their complete combustion. Finally, temperature sensing means is provided at the exit of the second stage chamber to control the variations of supplemental, conventional fuel to insure adiabatic combustion within the furnace. The stages of the furnace are held under negative pressure by induction fans downstream of the discharge of the second stage.

Other objects, advantages and features of this invention will become apparent to one skilled in the art upon consideration of the written specification, appended claims, and attached drawing.

BRIEF DESIGNATION OF THE DRAWING

The drawing is a sectioned elevation of the incinerator in which the present invention is embodied.

BEST MODE FOR CARRYING OUT THE INVENTION

General Considerations

The present disclosure centers about an incinerator, or furnace, in which waste, contaminated to a relatively low level of radiation, is drastically reduced in volume in preparation for ultimate disposal. Upstream of the furnace, or incinerator, there is a system to gather, collect, and process the low-radiation waste into a feed for the furnace. Parallel with the waste feed, conventional fuel will be supplied to the furnace to insure support for the combustion of the waste. Also, the total amount of air for combustion will be supplied in excess for that required for stoichiometric combustion. Note is to be taken that the furnace is provided with a substantial refractory lining to supply thermal inertia for the adiabatic combustion of the process. The calorific value of the waste is expected to vary widely. A control system will be provided to vary the rate at which conventional fuel will be supplied. Control of the supplemental fuel rate will be exerted by a system responsive to the temperature of the products of combustion which exit the furnace. The thermal inertia provided by the refractory backs up the fuel control system and insures the continuous adiabatic combustion of the waste.

The combustion process within the furnace will be carried out under a negative pressure. This negative pressure, insured by induced draft fans downstream of the furnace, will guard against radiation leakage from the furnace.

The overall configuration of the interior of the furnace insures turbulence of the mixture of fuel/waste and excess air to largely consume the waste in suspension. That part of the waste which fails to burn in suspension will be directed to impinge upon a grate to insure completion of its combustion.

The system contemplated is designed to process miscellaneous dry solid wastes, liquid waste concentrates, and ion exchange resin slurries and sludges. These wastes are collected in their respective storage areas and processed separately through a single incinerator. Concentrated liquids and resin slurries are injected directly into the incinerator. Solid combustible wastes are processed by shredding equipment to obtain the necessary size reduction prior to feeding into the incinerator. The incinerator provides suspension burning, operating at all times in a negative draft and excess air condition to insure complete and safe combustion. Combustion air is supplied by induction fans which also maintain the negative pressure on the entire system. The combustion process produces small particles of oxides and dry salts which are carried with the flue gas for subsequent removal by filters. Ash discharged from the baghouse filter and the combustor grate may be solidified by a variety of waste immobilization systems, including asphalt, concrete and polymer binders.

The foregoing system is capable of reducing low level nuclear combustible waste to 2% of its original volume. In making this reduction, the system significantly cuts the disposal costs of prior art systems. All of the varied forms of waste are reduced to dry stable ash. As indicated, this inert material is easily packaged with immobilization processes. Contemplating a supplemental fuel of oil or natural gas, the system can process up to 215 lbs./hr. of solid combustible material, and up to 1,000 lbs./hr. of aqueous waste.

The Collection, or Gathering, System:

Disclosure of the preferred embodiment of the invention will take up the review of the sources of radioactive wastes to be incineration-reduced. Influents to the system include bottoms from the waste evaporators, exhausted ion exchange resins, filter cartridges, and other miscellaneous low-level radioactive solid materials from a nuclear reactor installation. The expected volumes of waste from a Typical 1000 MW Pressurized Water Reactor (PWR) are tabulated as follows:

| Source | Expected Waste Volume/year |
|---|---|
| Concentrated Liquid Waste (1) | 188,000 gals. |
| Ion Exchange Resin Waste | 700 cu. ft. |
| Filter Cartridges | 100 cu. ft. |
| Miscellaneous Combustible Trash (2) | 10,000 cu. ft. |

(1) Assumes a concentration factor of 20 for boric acid waste and a concentration factor of 6 for sodium sulfate waste.
(2) Assumes bulk density of 10 lbs. per cu. ft.

The following tabulation lists the expected volumes of waste from a Typical 1000 MW Boiling Water Reactor (BWR):

| Source | Expected Waste Volume/year |
|---|---|
| Concentrated Liquid Waste (1) | 387,000 gals. |
| Ion Exchange Resin Waste | 1,200 cu. ft. |

-continued

| Source | Expected Waste Volume/year |
|---|---|
| Filter Cartridges | 100 cu. ft. |
| Miscellaneous Combustible Trash (2) | 12,000 cu. ft. |
| Filter/Demineralizer Sludge | 10,000 cu. ft. |

(1) Assumes a concentration factor of 20 for boric acid waste and a concentration factor of 6 for sodium sulfate waste.
(2) Assumes bulk density of 10 lb/cu. ft.

The collection sub-systems for the radioactive wastes will not be disclosed. The disclosure will proceed directly to the incinerator structure per se, leaving to the foregoing information an appreciation of the material supplied the incinerator as waste.

The Incinerator Structure Per Se:

One of the actual reductions to practice of the incinerator disclosed has been conservatively designed to process 1000 pounds per hour of noncumbustible (no heating value) feed material such as water. Based upon the limitation and the range of conventional burners, the actual reduction to practice of the incinerator was capable of handling approximately 215 pounds per hour of solid combustible material with an average heating value of 8000 Btu/pound mass. The amount of solid material processed varied, depending upon the heating value of the combustible waste product supplied to the incinerator.

In general, the design of the actual reduction to practice of the incinerator disclosed includes a well-insulated, refractory-lined chamber. Some of the expected features of this incinerator are:

Substantially complete suspension burning of the solid material of the waste feed Provision of a grate upon which the larger and/or less reactive solid waste materials are precipitated to lengthen their residence time required for complete combustion Staged air flow at constant rates $H_2O$ evaporation capacity up to 1000 lbs./hr.

Conventional fuel firing equipment for supplemental, conventional fuel

Limitations on temperature variations to the exit of the products of combustion, termed adiabatic operation From one perspective, the incinerator is divided into two sections, vertically oriented in their connection. As the first section directly receives both the waste material to be reduced in volume by combustion, and the supplemental fuel, as well as the first portion of combustion air, it may be regarded as a burner housing. The goal of the present invention is to initially introduce into this housing, as primary air, the amount of air which will produce substantially stoichiometric combustion when mixed with both the waste and supplemental fuels. The objective of this proportioning of air to fuel is to bring the temperature of the combustion of the mixture to as high a value as possible. This highest temperature value is to insure that the liquid waste is evaporated.

Continuing to consider the first stage housing as a burner, means are provided to introduce the stoichiometric quantity of primary air in a mechanical swirl, or cyclonic pattern. This means may take several alternate forms. It may comprise no more than arranging the direction of the air, fuel, and waste tangential to the inner wall of the burner housing. The means may also include impingement structure in the flow path of the mixture to divert it in a spiral or cyclone. Whatever structural means is provided, the cyclonic pattern is established to promote mixing of the waste and fuel with air so that their subsequent stoichiometric combustion will proceed as quickly as possible at the highest attainable temperature.

As the swirling, cyclonic, combusting mixture exits downward from the first stage housing, secondary air is supplied in the amount to drive the combustion toward completion while the solid waste particles are in suspension. This secondary air is mechanically introduced near the connection between the upper, first-stage burner housing and the lower, second-stage furnace cavity. By the time the combusting mixture is introduced into the lower furnace cavity, the cyclonic pattern has begun to dissipate. Combining with the secondary air, the combusting mixture continues to flow downwardly toward the bottom of the furnace cavity and toward a horizontal grate formed on the floor of the furnace cavity.

In the progress of combustion downward through the second-stage furnace cavity, the secondary air supplies an excess of oxygen, a finite amount in excess of the stoichiometric amount. Therefore, all that is needed is a sufficient residence time to complete the combustion of the waste. The equivalent of this residence time is provided by sharply diverting the combusting mixture upward from near the bottom of the furnace cavity. This sudden change of direction causes solid material, whose combustion has not been completed, to be cast, by inertia, on the grate below the sudden turn. The result is that these solid particles are mechanically held, by this grate, to complete their combustion in the environment of excess air. The products of combustion, diverted sharply upward, exit the furnace cavity at an intermediate point above the turn.

The suspension and grate combustion within the second stage furnace cavity is carried out with no substantial loss of heat from the furnace cavity. The efficient insulation by the refractory lining of the furnace cavity prevents this loss of heat. In effect, the furnace cavity can be termed a calorimeter with the heat released within, exiting only in the products of combustion which exit at the specified discharge opening. In this arrangement provided by the invention, the temperature of the products of combustion which exit the furnace cavity represent the variations in calorific value of the waste materials received by the first stage burner housing.

With the total air, both primary and secondary, established at a constant value, the stoichiometric combustion in the first-stage burner housing can be maintained by a variation of the supplemental conventional fuel supplied the housing. Therefore, a single point control element can be established at the exit of the second-stage furnace cavity to generate a signal which will control the regulation of the supplemental fuel supplied to the first-stage burner housing, with the result that the desired conditions of combustion will be maintained in the first and second stages of the incinerator.

In the drawing disclosure of the embodiment of the invention, the complete incinerator is designated 10, including its burner housing A and furnace cavity B. The burner housing A is cylindrical and accepts the waste fuel from the collecting and preparation systems through waste fuel guide pipe 11. The supplemental, conventional fuel is introduced into burner housing A through supplemental fuel admission assembly 12. Substantially, or approximately, one-half the total combustion air is supplied to the burner through primary air inlet port 13. This primary air, within the burner housing A, is diverted, or directed, down into a path tangent to the internal wall of the burner housing. In its tight, cyclonic swirl pattern within the burner housing A, the primary air is expected to quickly mix with both the waste and supplemental fuel. This mixture is immediately ignited to burn at the intense temperature of stoichiometric combustion. As previously explained, this is the high temperature required to evaporate the liquid waste.

As the swirling, combusting mixture erupts downwardly from the burner housing A into the lower furnace cavity B, the remaining combustion air is fed into the zone of combustion through secondary air inlet ports 14. The volume and capacity of the furnace cavity B is established to provide sufficient residence time with maximum $O_2$ concentration to complete combustion of the waste material in suspension.

As the combusting mixture travels downwardly in furnace cavity B, it approaches the surface of grate 15. Grate 15 is mounted at the lower end of the furnace cavity B, beneath the descending combusting mixture. Baffle 16 is mounted across the lower portion of the furnace cavity to provide an exit passage 17 into which the combusting mass is sharply diverted. In its diversion, the combusting mixture precipitates solid waste which has not been completely reduced by combustion. This solid material, thrown by inertia from the combusting mixture, is expected to lodge upon grate 15 and be held there for the residence time required to complete its combustion. Therefore, the combusting mixture is expected to bounce from the lower portion of furnace cavity B, up passage 17, to exit at 18.

Both the burner housing A and furnace cavity B are held under negative pressure. An induction fan 19 is indicated downstream of exit 18 with which to generate the negative pressure and thereby obviate the escape of radioactive material from the incinerator during combustion. Also, note is to be taken of effective insulating refractory 20 with which the incinerator is internally lined. It is by means of this insulating refractory 20 that the adiabatic operation of the incinerator is insured. In short, all of the calorific input to the burner housing A appears in the products of combustion discharged from exit 18. The result is that the temperature sensed at exit 18 by temperature element 21 becomes a measure of the variations of the calorific value of the waste fed to burner housing A through inlet pipe 11.

It is an object of the present invention to maintain the total volume of combustion air supplied substantially constant while regulating the supplemental fuel into burner housing A through a measure of the exit temperature by the temperature element 21. Temperature element 21 is connected to a control station 22. It is well-known to introduce a signal from a temperature element, such as represented by element 21, into a signal useful to exert effective regulation on a supply pipe, such as supplemental fuel admission assembly 12. Adjustments of the effectiveness of this signal is expected to be available through standard structure at control station 22.

By establishing the combustion of the solid waste in the incinerator, there are delivered from exit 18, products of combustion which are made up of ash solids suspended in the exit gases. The solids have been reduced in size by the incineration. When these solids have been strained from the entraining gases, they can be compacted into small volumes for ultimate disposal. All of the low-level radiation is associated with these particles, so their capture and control cleans the gaseous fluids which can be released to the environment without pollution. Of course, as indicated previously, the treatment of these off-products of the incinerator is not the direct concern of the present invention. It is the reduction in size of the wastes which is the primary concern of the present invention to be carried out by the embodiment herein disclosed.

Conclusion

In summation, it is emphasized that the collecting and preparation systems for the low-level radiation waste upstream of conduit 11 are discussed and not shown by drawing. As important as these collecting and preparation systems are, their function is limited to supplying the material to be volumetrically reduced by incineration in the structure embodying the present invention. Correspondingly, the systems downstream of exit 18 of the furnace cavity have been discussed but not shown in the drawing. This lack of drawing disclosure does not symbolize a lack of importance of these downstream systems for separating the small amount of solids from the gaseous exhaust for packaging these solids so they may be safely stored.

Under a broad concept of the invention, an incinerator is claimed as first having a burner housing A into which the waste, supplemental fuel, and primary combustion air are introduced. The supplemental, conventional fuel is introduced into the burner housing through conduit 12, while the primary combustion air is introduced through conduit 13. Means are provided, either in the direction of conduit 13, or a diverter structure, which will swirl the primary air in burner housing A to thoroughly mix a stoichiometric amount of air with the waste and supplemental, conventional fuel to bring the ignition of this mixture to its highest temperature.

Embodiment of the broad concept continues to be claimed with the conduit 14 through which secondary air is added to the combusting mixture as it swirls from the burner housing A. The secondary air is added to elevate the level of oxygen well above stoichiometric conditions to promote incineration of the waste in suspension. This combustion continues as the combusting mixture passes downward in the cavity of furnace B. The refractory linings 20 of burner housing A and furnace cavity B insure the adiabatic combustion conditions therein. All of the combustion in the burner and furnace cavity is continued under the negative pressure supplied by induction fan 19.

With the products of combustion withdrawn from the furnace cavity B through exit 18, the temperature of these products is sensed by element 21. Finally, element 21, through control station 22, is maintained in continuous control of the supplemental, conventional fuel supplied burner A through conduit 12.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawing is to be interpreted in an illustrative and not in a limiting sense.

I claim:

1. An incinerator in which the volume of low-level radiation waste is reduced by combustion, including, a burner housing opening downwardly, a first conduit into the burner housing through which low-level radiation waste is flowed to the interior of the housing, a second conduit into the housing through which supplemental conventional fuel is flowed to the interior of the housing, a third conduit into the housing through which primary combustion air is flowed to the interior of the housing at a substantially stoichiometric rate, means within the housing for directing the primary combustion air into a cyclonic swirl which mixes the air and waste and fuel as they are ignited, a furnace cavity mounted below the burner housing with its top entry aligned with the burner housing exit to receive the combusting mixture of waste and fuel and air, a fourth conduit connected to the burner housing to introduce secondary combustion air into the mixture in quantities providing a total air in excess of stoichiometric combustion, a vertical downward flow path extended within the furnace cavity from the connection with the burner housing in which the waste is burned in suspension, a refractory lining for the burner housing and furnace cavity, an induction fan mounted at the exit of the furnace cavity to maintain the burner housing and furnace cavity under negative pressure, means for sensing the temperature of the products of combustion which exit the furnace cavity, and means for connecting the temperature sensing means to the supplemental conventional fuel conduit to regulate the rate of fuel flow under the control of the exit temperature.

2. The incinerator of claim 1, including a horizontal grate mounted across the lower portion of the furnace cavity, and a baffle means mounted in the furnace cavity to form a passageway with the cavity walls for the combusting mixture which sharply diverts the flow of the products of combustion upward at a point above the grate.

* * * * *